US010763030B2

(12) United States Patent
Sarver et al.

(10) Patent No.: US 10,763,030 B2
(45) Date of Patent: Sep. 1, 2020

(54) TRANSFORMER AND TRANSFORMER CORE

(71) Applicant: ABB Power Grids Switzerland AG, Baden (CH)

(72) Inventors: Charlie Sarver, Rocky Gap, VA (US); William E. Pauley, Bland, VA (US)

(73) Assignee: ABB Power Grids Switzerland AG, Baden (CH)

( * ) Notice: Subject to any disclaimer, the term of this patent is extended or adjusted under 35 U.S.C. 154(b) by 0 days.

(21) Appl. No.: 15/248,683

(22) Filed: Aug. 26, 2016

(65) Prior Publication Data

US 2017/0062118 A1 Mar. 2, 2017

Related U.S. Application Data

(60) Provisional application No. 62/211,760, filed on Aug. 29, 2015.

(51) Int. Cl.
*H01F 27/24* (2006.01)
*H01F 27/26* (2006.01)
*H01F 27/245* (2006.01)

(52) U.S. Cl.
CPC ..... *H01F 27/263* (2013.01); *H01F 27/245* (2013.01)

(58) Field of Classification Search
USPC ..... 336/216, 5, 212, 170
See application file for complete search history.

(56) References Cited

U.S. PATENT DOCUMENTS 2,911,603 A * 11/1959 Harke ..... H01F 27/25 336/5
3,129,377 A * 4/1964 Monroe ..... H01F 30/14 336/217
3,173,113 A * 3/1965 Beuke ..... H01F 27/245 336/216
4,166,992 A * 9/1979 Brueckner ..... H01F 27/245 336/155
4,200,854 A * 4/1980 DeLaurentis ..... H01F 27/245 29/606
4,479,104 A * 10/1984 Ettinger ..... H01F 27/343 336/219
4,520,556 A * 6/1985 Pasko, Jr. ..... H01F 27/245 29/606
2002/0067239 A1* 6/2002 Nathasingh ..... H01F 41/0213 336/234
2008/0231241 A1* 9/2008 Lewis ..... H02J 3/1878 323/215

* cited by examiner

*Primary Examiner* — Elvin G Enad
*Assistant Examiner* — Kazi S Hossain
(74) *Attorney, Agent, or Firm* — Sage Patent Group

(57) ABSTRACT

A unique transformer includes a first yoke formed of laminations oriented parallel to a first plane; a second yoke formed of laminations oriented parallel to the first plane; and a center leg formed of laminations oriented parallel to a second plane oriented at a non-zero angle relative to the first plane. The center leg includes a first end. The first yoke and the second yoke are in contact with the center leg at the first end. The transformer includes a coil disposed about the center leg, and a butt joint between the center leg and at least one of the first yoke and the second yoke.

19 Claims, 2 Drawing Sheets

TRANSFORMER AND TRANSFORMER CORE

FIELD OF THE INVENTION

The present application relates to transformers, and more particularly to transformer cores.

BACKGROUND

Transformers and transformer cores remain an area of interest. Some existing systems have various shortcomings, drawbacks and disadvantages relative to certain applications. For example, in some transformer cores, mitered joints between the yokes and the center leg may result in unnecessary scrap of the lamination material used to form the core, e.g., owing to notches being cut into the yoke to accommodate the center leg. Accordingly, there remains a need for further contributions in this area of technology.

SUMMARY

Embodiments of the present invention include a unique transformer. The transformer may include a first yoke formed of laminations oriented parallel to a first plane; a second yoke formed of laminations oriented parallel to the first plane; and a center leg formed of laminations oriented parallel to a second plane that is oriented at a non-zero angle relative to the first plane. The center leg includes a first end. The first yoke and the second yoke are in contact with the center leg at the first end. The transformer includes a coil disposed about the center leg, and a butt joint between the center leg and at least one of the first yoke and the second yoke.

BRIEF DESCRIPTION OF THE DRAWINGS

The description herein makes reference to the accompanying drawings wherein like reference numerals refer to like parts throughout the several views, and wherein.

DETAILED DESCRIPTION

Figure 1:
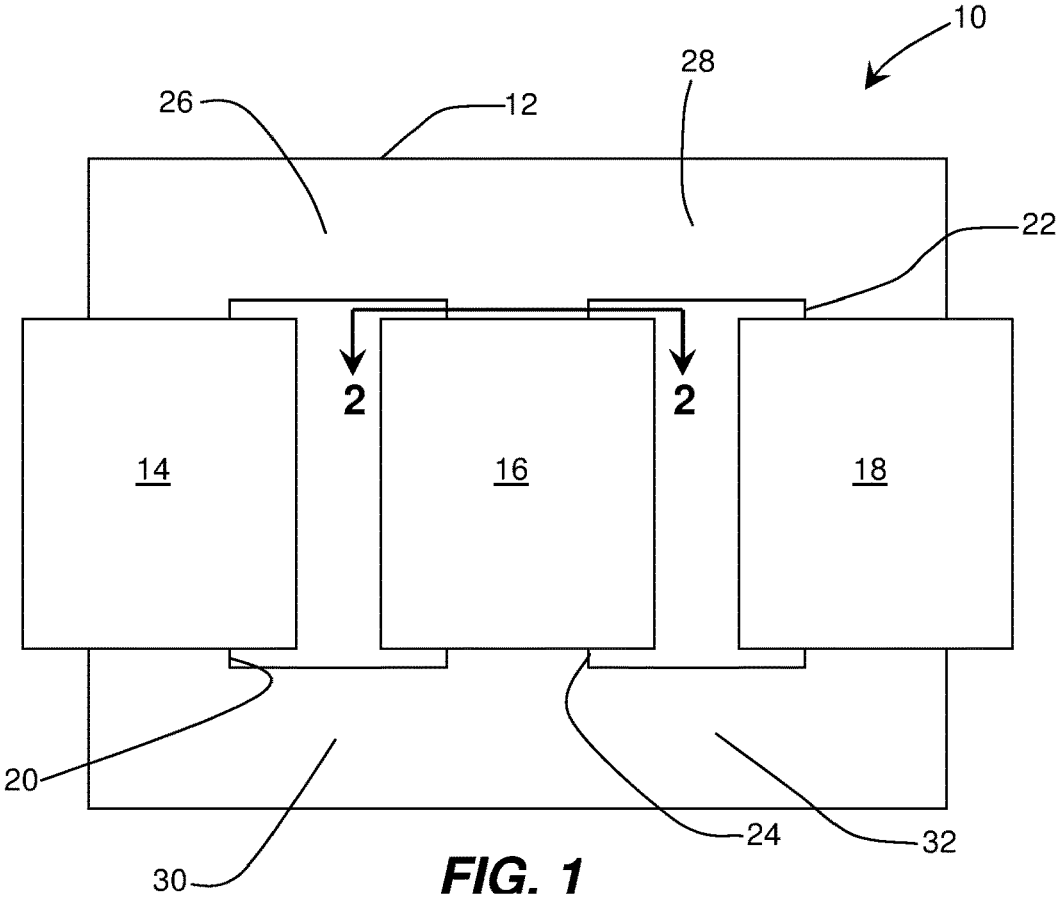
FIG. 1 schematically depicts some aspects of an electrical power transformer in accordance with a non-limiting example of an embodiment of the present invention.

For purposes of promoting an understanding of the principles of the Transformer, and Transformer Core, reference will now be made to the embodiments illustrated in the drawings, and specific language will be used to describe the same. It will nonetheless be understood that no limitation of the scope of the invention is intended by the illustration and description of certain embodiments of the invention. In addition, any alterations and/or modifications of the illustrated and/or described embodiment(s) are contemplated as being within the scope of the present invention. Further, any other applications of the principles of the invention, as illustrated and/or described herein, as would normally occur to one skilled in the art to which the invention pertains, are contemplated as being within the scope of the present invention.

Figure 2:
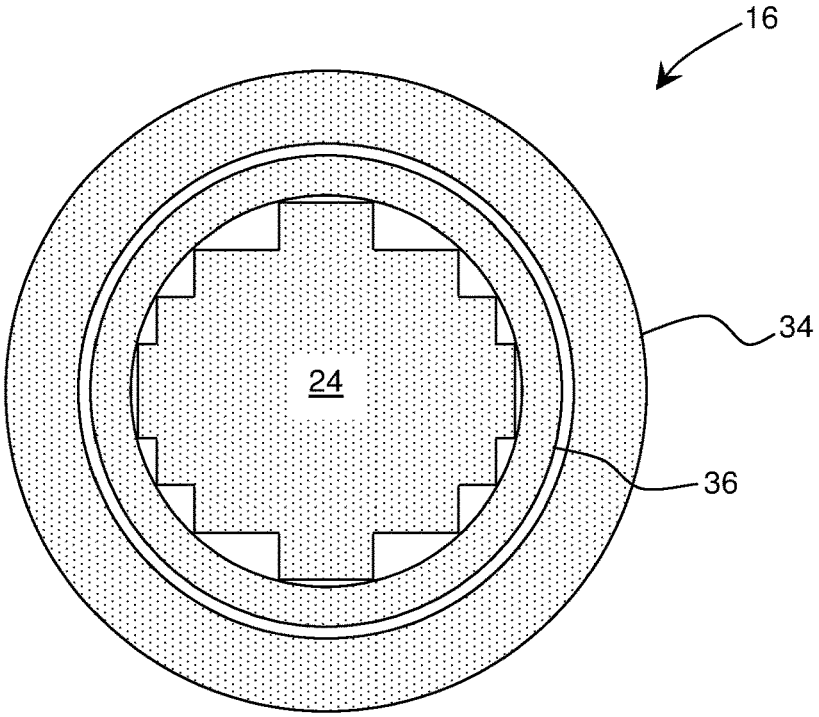
FIG. 2 schematically depicts some aspects of a core leg and a phase leg transformer in accordance with a non-limiting example of an embodiment of the present invention.

Referring to the drawings, and in particular FIGS. 1 and 2, some aspects of a non-limiting example of an electrical power transformer 10 in accordance with an embodiment of the present invention are depicted. In one form, transformer 10 is a three-phase transformer system. In other embodiments, transformer 10 may be a single-phase transformer or any other type of electrical power transformer. Transformer 10 includes a transformer core 12, and includes three phase leg transformers 14, 16 and 18. Core 12 includes outer legs 20 and 22, and a center leg 24.

The assembled core 12 forms one or more flux paths through legs 20, 22 and 24 and yokes 26, 28, 30 and 32. As set forth below, in some embodiments, a first flux path loop is formed between center leg 24, yoke 26, outer leg 20 and yoke 30, and a second flux path loop is formed between center leg 24, yoke 28, outer leg 22 and yoke 32. The flux path(s) formed in core 12 may vary with the needs of the application.

Legs 20, 22 and 24 are magnetically coupled via yoke pieces or yokes 26, 28, 30 and 32, and together with yokes 26, 28, 30 and 32 form magnetic flux paths extending through core 12. Center leg 24 forms a magnetic flux path with yokes 26, 28, 30 and 32, to allow lines of magnetic flux to extend continuously through yoke 30, center leg 24 and yoke 26, and to allow lines of magnetic flux to extend continuously through yoke 32, center leg 24 and yoke 28. Outer leg 20 forms a magnetic flux path with yokes 26 and 30, to allow lines of magnetic flux to extend continuously through yoke 26, outer leg 20 and yoke 30. Outer leg 22 forms a magnetic flux path with yokes 28 and 32, to allow lines of magnetic flux to extend continuously through yoke 28, outer leg 22 and yoke 32. Thus, in some embodiments, a first flux path loop may be defined by center leg 24, yoke 28, outer leg 22 and yoke 32, which may, for example, direct lines of magnetic flux in a clockwise or counterclockwise direction between mating legs and yokes. Similarly, in some embodiments, a second flux path loop may be defined by center leg 24, yoke 26, outer leg 20 and yoke 30, which may, for example, direct lines of magnetic flux in a clockwise or counterclockwise direction between mating legs and yokes.

Phase leg transformers 14, 16 and 18 are disposed about respective legs 20, 22 and 24 of transformer core 12. In one form, each phase leg transformer, e.g., an example of which is phase leg transformer 16 as illustrated in FIG. 2, includes a low voltage (LV) transformer coil assembly 34 and a high voltage (HV) transformer coil assembly 34 disposed about the respective transformer leg, e.g., a center leg 24. In other embodiments, one or more additional coils may be included in one or more phase leg transformers, e.g., a medium voltage coil or a tap coil. In the embodiment of FIG. 2, center leg 24 is cruciform. In other embodiments, other leg geometries may be employed.

Figure 3:
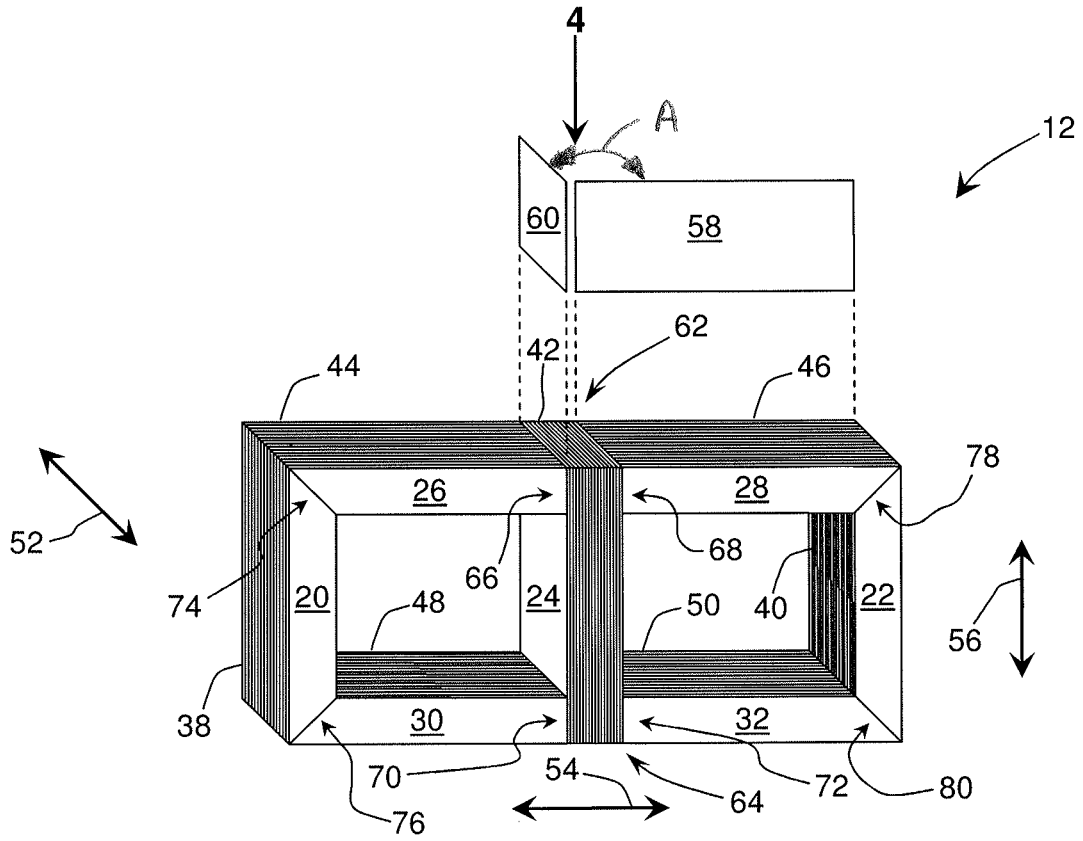
FIG. 3 schematically depicts some aspects of a transformer core in accordance with a non-limiting example of an embodiment of the present invention.

Referring to FIG. 3, some aspects of a non-limiting example of a transformer core 12 in accordance with an embodiment of the present invention are schematically depicted. In the embodiment of FIG. 3, center leg 24 is a rectangular leg. In other embodiments, center leg 24 may have a square, cruciform, round (or essentially round) cross section or any suitable cross section. Legs 20, 22 and 24, and yokes 26, 28, 30 and 32 are each formed of a plurality of laminations, namely, plurality of laminations 38, plurality of laminations 40, plurality of laminations 42, plurality of laminations 44, plurality of laminations 46, plurality of laminations 48 and plurality of laminations 50, respectively.

In one form, laminations 38, 40, 42, 44, 46, 48 and 50 are formed of electrical steel, such as low-loss high-permeability silicon steel. In other embodiments, other materials may be employed.

Plurality of laminations 38 are stacked in a direction 52 to form leg 20. Similarly, plurality of laminations 40, 44, 46, 48 and 50 are stacked in direction 52 to form respective leg 22 and yokes 26, 28, 30 and 32. Each lamination of plurality of laminations 38, 40, 44, 46, 48 and 50 for legs 20 and 22, and for yokes 26, 28, 30 and 32 has major dimensions (i.e., exclusive of lamination sheet thickness) that extend in directions 54 and 56, and is oriented parallel to a plane 58. Each lamination 38, 40, 44, 46, 48 and 50 has a sheet thickness measured in direction 52, which is perpendicular to plane 58. In other embodiments, one or more of plurality of laminations 38, 40, 44, 46, 48 and 50 may be stacked in one or more other directions and/or may be three-dimensional laminations.

Yoke 26 and corresponding plurality of laminations 44 are coincident with respective yoke 28 and corresponding plurality of laminations 46, i.e., disposed along the same line. Similarly, yoke 30 and corresponding plurality of laminations 48 are coincident with respective yoke 32 and corresponding plurality of laminations 50. In one form, each of yokes 26, 28, 30 and 32 have the same length. In some embodiments, yokes 26, 28, 30 and 32 have the same average length, but the length of each lamination forming the yoke pieces may vary as needed to produce a desired step lap joint with an outer leg, e.g., a mitered step lap joint or a butt lap joint. In other embodiments, yokes 26, 28, 30 and 32 have the same average length, but the length of each lamination forming the yoke pieces may vary as needed to produce a desired step lap joint with an outer leg, e.g., a mitered step lap joint or a butt lap joint, and/or as needed to accommodate the steps of one or more cruciform legs. Leg 20 and corresponding plurality of laminations 38 are parallel to leg 22 and corresponding plurality of laminations 40, which is parallel to plane 58. Center leg 24 is parallel to outer legs 20 and 22, except that the laminations of center leg 24 are stacked in a different direction than those of outer legs 20 and 22, as set forth herein.

In one form, plurality of laminations 42 are stacked in a direction 54 to form center leg 24. In one form, each lamination of plurality of laminations 42 has primary dimensions (i.e., exclusive of lamination sheet thickness) that extend in directions 52 and 56, and is oriented parallel to a plane 60. Each lamination 42 of center leg 24 has a sheet thickness measured in direction 54, which is perpendicular to plane 60. Plane 60 forms an angle A with plane 58. In one form, plane 60 is perpendicular to plane 58 or angle A is 90 degrees as illustrated in FIG. 3. In other embodiments, plane 60 may be disposed at other angles relative to plane 58, e.g., other non-zero angles. In these other embodiments, angle A is greater than zero degrees and less than 90 degrees. In other embodiments, laminations 42 may be stacked in one or more other directions and/or may be three-dimensional laminations.

In one form, directions 52, 54 and 56 are mutually perpendicular. In other embodiments, directions 52, 54 and 56 may not be mutually perpendicular. In one form, the laminations of yokes 26, 28, 30 and 32 each have the same height, e.g., as measured in direction 56. In other embodiments, the laminations that form each yoke may have two or more different heights, e.g., so as to maintain a desired cross sectional area for the flux paths, such as the cross sectional area of legs 20, 22 and 24 when viewed downward in direction 56 in FIG. 3. Similarly, the width of the laminations of legs 20 and 22 in direction 54, and the depth of the laminations of leg 24 may be varied to achieve a desired cross sectional area for the flux paths therethrough, and may be the same or different throughout each leg.

Center leg 24 has a top end 62 and a bottom end 64. Yokes 26 and 28 contact center leg 24 at top end 62 on opposing sides of center leg 24. Center leg 24 and yokes 26 and 28 are constructed to form respective butt joints 66 and 68 between center leg 24 and yokes 26 and 28. Yokes 30 and 32 contact center leg 24 at bottom end 64 on opposing sides of center leg 24. Center leg 24 and yokes 30 and 32 are constructed to form respective butt joints 70 and 72 between center leg 24 and yokes 70 and 72. Yokes 26 and 30 engage outer leg 20. In one form, yokes 26 and 30, and outer leg 20 are constructed to form respective mitered step lap joints 74 and 76. In other embodiments, joints 74 and/or 76 may be another type of joint, e.g., butt or butt lap joints. Yokes 28 and 32 engage outer leg 22. In one form, yokes 28 and 32, and outer leg 22 are constructed to form respective mitered step lap joints 78 and 80. In other embodiments, joints 78 and/or 80 may be another type of joint, e.g., butt or butt lap joints. In various embodiments, the joints between one or more of the legs and one or more of the yokes may take any suitable form.

Figure 4:
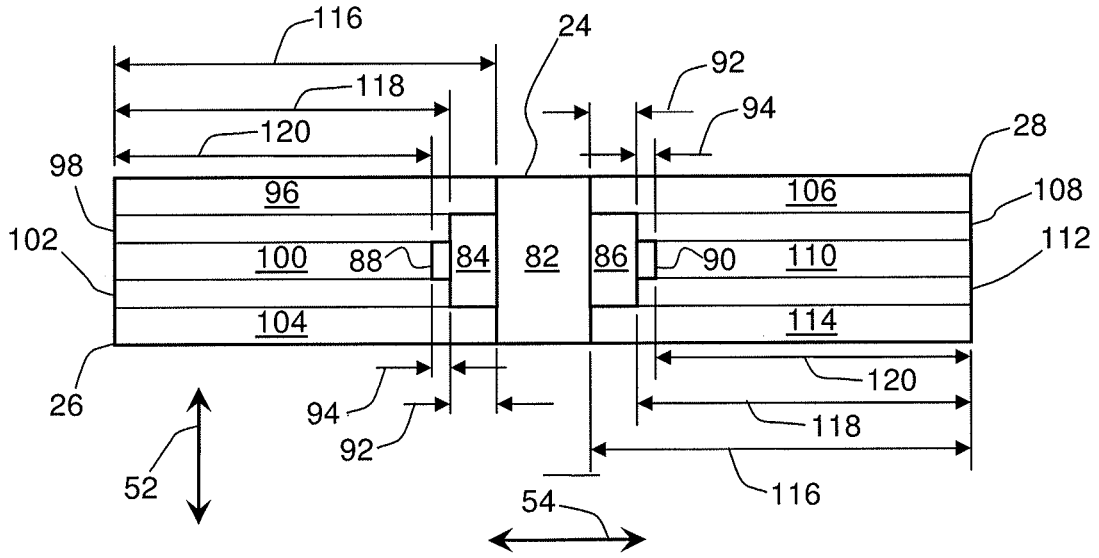
FIG. 4 schematically depicts some aspects of a transformer core in accordance with a non-limiting example of an embodiment of the present invention.

Referring to FIG. 4, some aspects of a non-limiting example of a transformer core 12 in accordance with an embodiment of the present invention are schematically depicted. In the embodiment of FIG. 4, center leg 24 is cruciform, and includes a central portion 82, first steps 84, 86 on each side of central portion 82, and second steps 88, 90 adjacent to and outward of steps 84, 86. Although only two steps per side of center leg 24 are illustrated in FIG. 4, it will be understood that the number of steps is illustrative only, and that the actual number of steps in any given embodiment may vary in accordance with the needs of the application. Steps 84 and 86 have the same length 92 in direction 54, and steps 88 and 90 have the same length 94 in direction 54.

Yokes 26 and 28 are subdivided into a plurality of subsets of laminations based on the number of steps on the corresponding sides of cruciform leg 24, wherein the length of each subset varies based on the length of each step. Yoke 26 is subdivided into subsets 96, 98, 100, 102 and 104, and yoke 28 is subdivided into subsets 106, 108, 110, 112 and 114. Subsets 96, 104, 106 and 114 have the same length 116 in direction 54. Subsets 98, 102, 108 and 112 have the same length 118, which is shorter than length 116 by the lengths 92 of respective steps 84 and 86. Subsets 100 and 110 have the same length 120, which is shorter than length 118 by the lengths 94 of respective steps 88 and 90.

As mentioned previously, embodiments of the present employ butt joints between the yokes and the center leg, which may, in some embodiments, reduce scrap, as compared to cores that use notched mitered joints between the yokes and the center leg.

Embodiments of the present invention include a transformer, comprising: a first yoke formed of a plurality of first yoke laminations oriented parallel to a first plane; a second yoke formed of a plurality of second yoke laminations oriented parallel to the first plane; a center leg formed of a plurality of leg laminations oriented parallel to a second plane that is oriented at a non-zero angle relative to the first plane, wherein the center leg includes a first end, and wherein the first yoke and the second yoke are in contact with the center leg at the first end; a coil disposed about the center leg; and a butt joint between the center leg and at least one of the first yoke and the second yoke.

In a refinement, the second plane is perpendicular to the first plane.

In another refinement, the center leg is a cruciform leg.

In yet another refinement, a first yoke lamination of the plurality of first yoke laminations is defined by a length dimension; and a second yoke lamination of the plurality of second yoke laminations is defined by the same length dimension.

In still another refinement, each first yoke lamination of the plurality of first yoke laminations and each second yoke lamination of the plurality of second yoke laminations have the same height.

In yet still another refinement, the transformer further comprises an outer leg, and a mitered joint between the first yoke and the outer leg.

In a further refinement, the plurality of first yoke laminations includes a first subset of laminations defined by a first length dimension, and a second subset of laminations defined by a second length dimension different than the first length dimension.

In a yet further refinement, the plurality of second yoke laminations includes a third subset of laminations defined by the first length dimension, and a fourth subset of laminations defined by the second length dimension.

In a still further refinement, the transformer is a 3-phase transformer.

Embodiments of the present invention include a transformer, comprising: a coil; a first plurality of laminations oriented parallel to a first plane; a second plurality of laminations oriented parallel to the first plane and coincident with the first plurality of laminations; and a third plurality of laminations oriented parallel to a second plane, wherein the second plane is disposed at a non-zero angle relative to the first plane; wherein the third plurality of laminations forms a magnetic flux path with both the first plurality of laminations and the second plurality of laminations; and wherein the coil is disposed about the third plurality of laminations.

In a refinement, the second plane is perpendicular to the first plane.

In another refinement, the first plurality of laminations forms a first yoke of a transformer core; the second plurality of laminations forms a second yoke of the transformer core; and the third plurality of laminations forms a center leg of the transformer core.

In yet another refinement, the transformer further comprises a butt joint between the center leg and at least one of the first yoke and the second yoke.

In still another refinement, a lamination of the first plurality of laminations is defined by a length dimension; and a lamination of the second plurality of laminations is defined by the same length dimension.

In yet still another refinement, each lamination of the first plurality of laminations and each lamination of the second plurality of laminations have the same height.

In a further refinement, the first plurality of laminations includes a first subset of laminations defined by a first length dimension, and a second subset of laminations defined by a second length dimension different than the first length dimension.

Embodiments of the present invention include a transformer core, comprising: a first plurality of laminations oriented parallel to a first plane; a second plurality of laminations oriented parallel to the first plane and coincident with the first plurality of laminations; and a third plurality of laminations oriented parallel to a second plane, wherein the second plane is disposed at a non-zero angle relative to the first plane, and wherein the third plurality of laminations forms a magnetic flux path with both the first plurality of laminations and the second plurality of laminations.

In a refinement, the second plane is perpendicular to the first plane; the first plurality of laminations form a first yoke of the transformer core; the second plurality of laminations form a second yoke of the transformer core; and the third plurality of laminations form a center leg of the transformer core.

In another refinement, the center leg is a cruciform leg.

In yet another refinement, the center leg is a rectangular leg.

While the invention has been described in connection with what is presently considered to be the most practical and preferred embodiment, it is to be understood that the invention is not to be limited to the disclosed embodiment (s), but on the contrary, is intended to cover various modifications and equivalent arrangements included within the spirit and scope of the appended claims, which scope is to be accorded the broadest interpretation so as to encompass all such modifications and equivalent structures as permitted under the law. Furthermore it should be understood that while the use of the word preferable, preferably, or preferred in the description above indicates that feature so described may be more desirable, it nonetheless may not be necessary and any embodiment lacking the same may be contemplated as within the scope of the invention, that scope being defined by the claims that follow. In reading the claims it is intended that when words such as "a," "an," "at least one" and "at least a portion" are used, there is no intention to limit the claim to only one item unless specifically stated to the contrary in the claim. Further, when the language "at least a portion" and/or "a portion" is used the item may include a portion and/or the entire item unless specifically stated to the contrary.

What is claimed is:

1. A transformer, comprising:

a first yoke formed of a plurality of first yoke laminations oriented parallel to a first plane, the plurality of first yoke laminations includes a first subset of laminations positioned adjacent an outer region thereof and a second subset of laminations positioned inward of and adjacent to the outer region, the first subset having a first length dimension and the second subset having a second length dimension shorter than the first length dimension;

a second yoke formed of a plurality of second yoke laminations oriented parallel to the first plane;

a center leg formed of a plurality of center leg laminations oriented parallel to a second plane that is oriented at an angle relative to the first plane, wherein the angle is less than 90 degrees, wherein the center leg includes a first end, and wherein the first yoke and the second yoke are in direct contact with the center leg at the first end;

a coil disposed around the center leg;

a butt joint between the first end of the center leg and at least one of the first yoke and the second yoke;

an outer leg formed of a plurality of outer leg laminations, wherein the outer leg and the first yoke are in direct contact; and a mitered joint between the first yoke and the outer leg.

2. The transformer of claim 1, wherein the second plane is perpendicular to the first plane.

3. The transformer of claim 1, wherein the center leg is a cruciform leg.

4. The transformer of claim 1, wherein a first yoke lamination of the plurality of first yoke laminations is defined by a length dimension; and wherein a second yoke lamination of the plurality of second yoke laminations is defined by the same length dimension.

5. The transformer of claim 1, wherein each first yoke lamination of the plurality of first yoke laminations and each second yoke lamination of the plurality of second yoke laminations have a same height.

6. The transformer of claim 1, wherein the plurality of second yoke laminations includes a third subset of laminations defined by the first length dimension, and a fourth subset of laminations defined by the second length dimension.

7. The transformer of claim 1, wherein the transformer is a 3-phase transformer.

8. A transformer, comprising:

a coil;

a first plurality of laminations oriented parallel to a first plane, the first plurality of laminations includes a first subset of laminations, a second subset of laminations and a third subset of laminations positioned between the first and second subsets of laminations, wherein each of the first, second and third subsets having a length dimension and the third length dimension is shorter than the length dimension of the first and second subsets;

a second plurality of laminations oriented parallel to the first plane and coincident with the first plurality of laminations;

a third plurality of laminations oriented parallel to a second plane, wherein the second plane is disposed at an angle that is less than 90 degrees relative to the first plane, wherein the third plurality of laminations is in magnetic flux communication with both the first plurality of laminations and the second plurality of laminations; and wherein the coil is disposed about the third plurality of laminations; and wherein the first plurality of laminations forms a first yoke of a transformer core, the second plurality of laminations forms a second yoke of the transformer core, and the third plurality of laminations forms a center leg of the transformer core, wherein the center leg includes a first end, and wherein the first yoke and the second yoke are in direct contact with the center leg at the first end.

9. The transformer of claim 8, further comprising a butt joint between the center leg and at least one of the first yoke and the second yoke.

10. The transformer of claim 8, wherein a length of the lamination of the first plurality of laminations and a length of the lamination of the second plurality of laminations is defined by a same length dimension.

11. The transformer of claim 8, wherein each lamination of the first plurality of laminations and each lamination of the second plurality of laminations have a same height.

12. The transformer of claim 8, wherein the length dimension of the first subset of laminations is different from the length dimension of the second subset of laminations.

13. A transformer core, comprising:

a first plurality of laminations oriented parallel to a first plane, the first plurality of laminations includes a first subset of laminations, a second subset of laminations and a third subset of laminations positioned between the first and the second subsets of laminations, wherein each of the first, second and third subsets having a length dimension and the length dimension of the third subset is shorter than the length dimension of the first and second subsets, wherein the first plurality of laminations form a first yoke of the transformer core;

a second plurality of laminations oriented parallel to the first plane and coincident with the first plurality of laminations, wherein the second plurality of laminations form a second yoke of the transformer core; and a third plurality of laminations oriented parallel to a second plane, wherein the second plane is disposed at an angle that is less than 90 degrees relative to the first plane, wherein the third plurality of laminations is in magnetic flux communication with both the first plurality of laminations and the second plurality of laminations, and wherein the third plurality of laminations form a center leg of the transformer core, wherein the center leg includes a first end, and wherein the first yoke and the second yoke are in direct contact with the center leg at the first end.

14. The transformer of claim 13, wherein the center leg is a cruciform leg.

15. The transformer of claim 13, wherein the center leg is a rectangular leg.

16. The transformer of claim 1, wherein the angle is less than 90 degrees.

17. The transformer of claim 8, wherein the angle is less than 90 degrees.

18. The transformer of claim 8, wherein the center leg is a cruciform leg.

19. The transformer of claim 13, wherein the angle is less than 90 degrees.

* * * * *